US006544102B2

(12) United States Patent
Schäfer et al.

(10) Patent No.: US 6,544,102 B2
(45) Date of Patent: Apr. 8, 2003

(54) DEVICE FOR CENTERING CLAMPING OF WORKPIECES, IN PARTICULAR OPTICAL LENSES, FOR EDGE MACHINING THEREOF

(75) Inventors: Erhard Schäfer, Weilmünster (DE); Holger Schäfer, Weilmünster (DE)

(73) Assignee: Loh Optikmaschinen AG (DE)

( * ) Notice: Subject to any disclaimer, the term of this patent is extended or adjusted under 35 U.S.C. 154(b) by 57 days.

(21) Appl. No.: 09/792,563

(22) Filed: Feb. 23, 2001

(65) Prior Publication Data

US 2001/0031606 A1 Oct. 18, 2001

(30) Foreign Application Priority Data

Feb. 24, 2000 (DE) ..... 100 08 710

(51) Int. Cl.[7] ..... B24B 9/14

(52) U.S. Cl. ..... 451/5; 451/43; 451/256; 451/384

(58) Field of Search ..... 451/5, 11, 14, 451/42–44, 64, 177, 255, 256, 342, 343, 364, 365, 367, 384, 390, 414, 480, 481, 508

(56) References Cited

U.S. PATENT DOCUMENTS

| | | | | | |
|---|---|---|---|---|---|
| 3,686,796 | A | * | 8/1972 | Clark | 451/360 |
| 4,419,846 | A | * | 12/1983 | Schimitzek et al. | 451/159 |
| 4,926,588 | A | * | 5/1990 | Brueck | 384/118 |
| 4,941,291 | A | * | 7/1990 | Brueck | 384/1 |
| 4,951,421 | A | * | 8/1990 | Brueck | 384/1 |
| 4,972,632 | A | * | 11/1990 | Brueck | 451/256 |
| 5,144,561 | A | * | 9/1992 | Soper | 451/5 |
| 5,951,376 | A | * | 9/1999 | Mandler | 451/178 |
| 6,116,783 | A | * | 9/2000 | Shirai et al. | 384/43 |
| 6,301,520 | B1 | * | 10/2001 | Hayashi | 700/192 |
| 6,325,697 | B1 | * | 12/2001 | Gottschalk | 451/11 |
| 6,383,061 | B1 | * | 5/2002 | Mandler | 451/42 |

FOREIGN PATENT DOCUMENTS

| | | | | |
|---|---|---|---|---|
| DE | 31 39 873 A1 | | 4/1983 | |
| DE | 37 44 115 C2 | | 3/1994 | |
| DE | 37 44 118 C2 | | 4/1994 | |
| DE | 37 44 116 C2 | | 10/1994 | |
| DE | 198 25 922 A1 | | 12/1999 | |
| JP | 402088107 A | * | 3/1990 | B23B/19/00 |
| JP | 403142156 A | * | 6/1991 | B24B/9/14 |
| JP | 405192855 A | * | 8/1993 | B24B/13/00 |
| JP | 411198013 A | * | 7/1999 | B24B/9/14 |
| JP | 2000176810 A | * | 6/2000 | B24B/9/14 |

* cited by examiner

*Primary Examiner*—Joseph J. Hail, III
*Assistant Examiner*—David B. Thomas
(74) *Attorney, Agent, or Firm*—McAndrews, Held & Malloy, Ltd.

(57) ABSTRACT

A device for centering clamping of lenses, comprises two aligned centering spindles, arranged one above the other, with bell clamps. One centering spindle is guided axially in a centering spindle guide and may be moved relative to the other centering spindle by a lifting apparatus. To achieve a smooth, sensitively adjustable clamping movement with precise axial alignment of the centering spindles to allow clamping of small lenses, a swivellable rocking lever is provided, to which the mobile centering spindle and a counterweight are coupled on opposing sides. The lifting apparatus is provided with an electric motor-driven ball screw, which raises or lowers the mobile centering spindle and/or the centering spindle guide is equipped with linear guide units, which are arranged on each side of the mobile centering spindle in substantially play-free manner between the latter and a box-type structure.

64 Claims, 7 Drawing Sheets

DEVICE FOR CENTERING CLAMPING OF WORKPIECES, IN PARTICULAR OPTICAL LENSES, FOR EDGE MACHINING THEREOF

BACKGROUND OF THE INVENTION

The present invention relates in general to a device for centering clamping of workpieces in the field of high-precision optics, the watch and clock making industry and the semiconductor industry, where workpieces have initially to be clamped in a centred manner and subsequently machined at the edge and/or scanned. In particular, the invention relates to a device for centering clamping of optical lenses, by means of which it is possible to clamp a lens in centred manner for edge machining thereof by the so-called bell clamp method.

Lenses for objectives and the like are "centred" after machining of the optical surfaces, so that the optical axis, the position of which is distinguished by the straight line through the two centres of curvature, also passes through the geometric centre of the lens. To this end, the lens is initially aligned and clamped between two aligned centering spindles in such a way that the two centres of curvature of the lens coincide with the common axis of rotation of the centering spindles. The edge of the lens is then machined in a defined relationship to the optical axis of the lens, as is necessary later for mounting the lens in a holder. During this process, the edge, depending on the material of which the lens is made (glass or plastics), is provided with a defined geometry, both in plan view onto the lens (circumferential contour of the lens) and viewed in radial section (contour of the edge, for instance linear construction or construction with bevel(s)), by machining with geometrically non-specific or specific cutting edges. Thus, during so-called centering of optical lenses, it is necessary to distinguish between the actual aligning and clamping process, with which the present invention is primarily concerned, and the subsequent machining of the lens edge.

A general overview of current centering technology practice is provided in this context by the article "Was leisten moderne Zentriermaschinen?" by Dipl.-Ing. (FH) Michael Leitz, published in "Jahrbuch für Optik und Feinmechanik 1999" (Ed.: Dr.-Ing. Wolf-Dieter Prenzel; Fachverlag Schiele & Schön GmbH, Berlin; ISBN 3 7949 0634 9), pages 161 to 175.

The above-mentioned bell clamp process is understood to mean an aligning and clamping process, in which the lens and its optical axis are aligned and clamped automatically relative to the vertically extending axis of rotation of the centering spindles between cup-shaped bell clamps provided on the centering spindles. To this end, the lens is positioned on the bell clamp of the lower centering spindle and the bell clamp of the upper centering spindle is displaced in the axial direction relative to the lower bell clamp until the upper bell clamp also lies with slight pressure against the lens. The lens is then displaced automatically in the transverse direction, as a result of the curvature of its optical surfaces, optionally with the addition of a suitable lubricant and/or rotation of the centering spindles, wherein the bell clamps move closer together. The transverse movement of the lens relative to the bell clamps and the axial relative movement of the bell clamps ends when the lens has assumed a position between the bell clamps which allows the minimum spacing of the bell clamps under the given geometric conditions. The lens, which then has its optical axis aligned relative to the axis of rotation of the centering spindles, is then clamped firmly between the bell clamps by increasing the clamping force and may be machined at the edge. The above-described bell clamp method reaches its limits in the case of lenses with only slightly curved optical surfaces. Below a certain value of the angle, also designated as the centering angle, formed between a tangent to the edge of the one optical surface of the lens at the clamping point (= contact point of the bell clamp) and a tangent to the edge of the other optical surface at the clamping point when viewed in radial section, self-locking arises, which prevents transverse movement of the lens relative to the bell clamps.

A device for centering clamping of optical lenses for edge machining thereof, which is designed to operate according to the above-described bell clamp method, has, inter alia, to the fulfil the following requirements. On the one hand, the axial alignment of the two centering spindles may deviate from one another by at most a few thousandths of a millimeter and must also be maintained during the entire clamping movement, i.e. the relative axial movement of the centering spindles. On the other hand, the clamping movement has to proceed as smoothly or non-jerkily as possible. This applies in particular to the moment at which the lens is caught between the two bell clamps. At this point, jerky movements must be avoided, so that the lens may slip into its optical axis and undergo automatic alignment without the risk of mechanical damage.

DESCRIPTION OF THE PRIOR ART

The prior art is not short of proposals for constructing a device for centering clamping of optical lenses. Thus, a machine for centering edge grinding and bevelling of optical lenses is known from DE 37 44 115 C2, DE 37 44 116 C2 and DE 37 44 118 C2 held by the applicant as signee, which machine comprises in a machine frame two axially aligned centering spindles, which carry bell clamps at their mutually facing ends. The lens may be chucked between the bell clamps for machining purposes by means of a clamping device acting on the axially displaceably guided lower centering spindle. Each of the centering spindles is here arranged in a quill and supported therein by supporting bearings.

In this prior art, the quill of the lower centering spindle is guided in a plurality of air bearings, which are formed in a thin-walled guide sleeve held in the machine frame. The guide sleeve tightly surrounds the quill and is in turn surrounded by a cavity formed in the machine frame and pressurisable by a pressure medium. The quill air bearing system is designed to provide very small forces for aligning the lens, sensitive adjustability of these forces, jerk-free advance of the lower centering spindle and high axial alignment precision of the centering spindles, whereby damage of the optical surfaces of the lens during alignment thereof should be avoided. Once the lens has reached its precise alignment position, the cavity surrounding the guide sleeve is pressurised with high pressure, such that the quill of the lower centering spindle is clamped in its respective position and the disadvantage immanent in the air bearings during machining, namely their low rigidity, which is insufficient to produce a good working result, is countered. However, a disadvantage of this prior art is in particular that smooth-running but nonetheless centred guidance of the quill of the lower centering spindle during alignment of the lens is bought at great cost with regard to apparatus and control systems.

The same is true of the clamping apparatus which, according to this prior art, comprises a plate-like yoke arranged beneath the quill of the lower centering spindle, in which yoke a diaphragm piston/cylinder unit is arranged centrically relative to the lower centering spindle, which piston/cylinder unit acts on the lower end of the lower centering spindle, and to which yoke a double-acting pressure cylinder with a short-stroke and a long-stroke piston is attached on each side of the centering spindle axis.

While the pressure cylinders here generate the stroke, until the long-stroke piston lies against the short-stroke piston, which is required to bring the bell clamps close enough together to leave a slight gap between the upper bell clamp and the lens lying on the lower bell clamp, the diaphragm piston/cylinder unit serves as a precision stroke means for the lens alignment process, by means of which the required clamping force for aligning the lens may be sensitively established.

In addition, DE 31 39 873 A1 discloses a centering device for a machine for edge grinding and bevelling optical lenses, having two centering spindles arranged in aligned manner one above the other, the lower of which is stationary while the upper one is mounted in axially displaceable manner and is under axial pressure loading in order to hold the optical lens. Axial displacement of the upper centering spindle into the adjusting position here proceeds, as does securing of the upper centering spindle in the adjusting position, by means of two lifting cylinders connected in parallel. The two lifting cylinders act simultaneously on a supporting plate, to which end the pistons of the lifting cylinders are brought into firm connection with the supporting plate by pressure bars. The two lifting cylinders may be caused to perform a lifting or lowering movement via a control means, in which movement there participate the supporting plate and the upper centering spindle, brought into axial driving connection with the supporting plate.

In addition to the complex control means required here to ensure synchronous lifting cylinder strokes, a disadvantage of this prior art is that stick-slip effects may arise in the lifting cylinders, which do not allow the sensitive, jerk-free advance of the upper centering spindle necessary for automatic aligning of the lens.

Finally, a device for centering optical lenses is described in DE 198 25 922 A1 which has two centering spindles arranged in aligned manner one above the other, which carry bell clamps for the lens at their mutually facing ends. While the lower centering spindle is here connected firmly to a machine frame, the upper centering spindle is guided in a guide cylinder by means of annular plain bearings, not described in any more detail, at the circumference of the centering spindle, such that it may perform axial movement. The guide cylinder connected firmly with the machine frame comprises a recess through which a gearwheel extends, which engages with external teeth on the upper centering spindle and effects axial feed thereof during rotation. The gearwheel is seated for rotation on a shaft mounted in the machine frame, which shaft is actively connected with an electric motor via a belt drive and with a compressed air cylinder via a lever. Finally, a manual lever is also attached to the shaft. With the aid of the electric motor, it is intended that the upper centering spindle be moved up and down in the axial direction inter alia for automatic centering of lenses. If centering is to be performed by manual operation, the upper centering spindle may be moved up and down by means of the manual lever against the force of the compressed air cylinder, which in this case generates the feed force.

A disadvantage of this prior art is that, on the one hand, the unilateral engagement of the gearwheel with the external teeth on the upper centering spindle produces a moment there which tends to tilt the upper centering spindle relative to the guide cylinder in the play-affected guide provided by the guide cylinder, which may result in a not inconsiderable alignment error between upper and lower centering spindles. On the other hand, the feed movement of the upper centering spindle may cause jerking as a result of the play between the teeth of the gearwheel and the external teeth on the upper centering spindle. To this may be added the fact that, owing to the stick-slip effects in the compressed air cylinder coupled compulsorily with the gear shaft via the lever, a jerk-free feed movement of the upper centering spindle cannot be guaranteed. Consequently, this centering device does not seem suitable for clamping in particular small lenses automatically by the bell clamp method without the optical surfaces of the lens being damaged.

SUMMARY OF THE INVENTION

Taking as basis the prior art according for example to DE 31 39 873 A1, the object of the invention is to provide a simply constructed device for centering clamping of workpieces, in particular optical lenses, for machining of the edges thereof, which allows a smooth and sensitively adjustable clamping movement with precise axial alignment of the centering spindles, such that it also allows in particular automatic clamping of small lenses by the bell clamp method, without damage to the optical surfaces of the lens.

This object is achieved by the features indicated in the independent claims. Advantageous or convenient modifications of the invention constitute the subject matter of the dependent claims.

According to a first aspect of the present invention, a device for centering clamping of workpieces, in particular optical lenses, for machining of the edges thereof, having two aligned centering spindles arranged one above the other, which spindles are each constructed at their mutually facing ends to accommodate a bell clamp, wherein at least one centering spindle is guided axially in a centering spindle guide and may be moved in the axial direction relative to the other centering spindle by means of a lifting apparatus, in order to align and chuck the workpiece, has a swivellable rocking lever, to one end of which there is coupled the axially mobile centering spindle and to the other end of which there is coupled at least one counterweight, in order to produce a moment at the rocking lever which counteracts the moment produced by the axially mobile centering spindle.

In contrast to the above-described prior art, the lifting apparatus here does not have to lift or hold the entire weight of the axially mobile centering spindle, but rather has only to oppose a slight force resulting from the moment arising at the rocking lever, which force preferably acts in the direction of the other centering spindle, which allows a very sensitive contacting or clamping movement of the axially mobile centering spindle in the direction of a lens to be clamped with very slight and readily apportionable forces, such that in particular very small lenses may be aligned and clamped automatically by the bell clamp method without the risk of damage to their optical surfaces or breaking of the lens. The slight force resulting from the moment arising at the rocking lever may be simply adjusted with respect to sign and amount in accordance with the respective requirements by a suitable choice of the lever arm ratio at the rocking lever or the mass of the counterweight.

The rocking lever may in principle also be arranged beneath the centering spindles. However, a design is preferred, according to which the rocking lever is arranged above the axially mobile upper centering spindle. This arrangement has, inter alia, the advantage that the rocking lever mechanism is less easily soiled and thus its smooth running remains guaranteed, in particular when the device according to the invention is a component of a machine for edge machining workpieces, in particular for centering edge-grinding and bevelling of optical lenses, which additionally comprises at least one driven tool spindle for a tool which may optionally be brought into engagement with the workpiece.

The rocking lever may have a forked portion, on which rollers are rotatably mounted, which engage with a drive flange attached to the axially mobile centering spindle. This ensures that, when the rocking lever swivels, no forces acting perpendicularly to the centering spindle axis are introduced into the axially mobile centering spindle, which could impair the axial alignment of the centering spindles and/or the smooth running of the centering spindle guide.

Although it is in principle possible for the lifting apparatus to be arranged on the centering spindle side of the rocking lever, an arrangement is preferred, according to which the lifting apparatus acts on the end of the rocking lever to which the counterweight is coupled. On the one hand, this allows the construction of the device according to the invention to be very compact. On the other hand, the lifting apparatus may thus be arranged spatially separately from the centering spindles when the device according to the invention is used in an edge machining machine, whereby soiling of the lifting apparatus, which might impair the smooth running of the lifting apparatus, is prevented.

The lifting apparatus can comprise a limit stop movable in the axial direction, which limit stop serves to absorb the moment arising at the rocking lever or forces resulting therefrom. In this embodiment of the device according to the invention, the axially mobile centering spindle, when performing its contacting or clamping movement, initially follows the axial movement of the lifting apparatus, with the rocking lever lying against the limit stop. When the bell clamp of the axially mobile centering spindle lies against the lens to be aligned or clamped with a slight force definedly adjustable by a suitable choice of the lever arm ratio at the rocking lever or the mass of the counterweight, the rocking lever then moves out of engagement with the limit stop of the lifting apparatus, such that the alignment process of the lens or the movement thereof perpendicular to the centering spindle axis may advantageously proceed uncoupled from the lifting apparatus.

The lifting apparatus may have a spring mechanism, by means of which a defined, additional force may be applied to the axially mobile centering spindle in the direction of the other centering spindle. Thus, an apportionably higher force may be applied via the spring mechanism to the workpiece to be aligned or clamped, which allows the workpiece to be chucked so firmly, for instance for edge machining thereof, that transverse forces acting on the workpiece cannot displace the latter out of its axially aligned position. The clamping force profile may here be readily adjusted or modified in accordance with the respective requirements by a suitable choice of springs with a specific spring characteristic. The spring mechanism may comprise one or more tension springs. However, it is preferable for the spring mechanism to comprise at least one compression spring.

According to a second aspect of the present invention, in the case of a device for centering clamping of workpieces, in particular optical lenses, for edge machining thereof, having two aligned centering spindles arranged one above the other, which spindles are each constructed at their mutually facing ends to accommodate a bell clamp, wherein at least one centering spindle is guided axially in a centering spindle guide and may be moved in the axial direction relative to the other centering spindle by means of a lifting apparatus, in order to align and chuck the workpiece, provision is made for the lifting apparatus to comprise a ball screw drivable by means of an electric motor, which ball screw serves to move one centering spindle relative to the other centering spindle in the axial direction, preferably under CNC control, in order to align the workpiece and also chuck it.

With the aid of only one driven ball screw, the entire movement process of the axially mobile centering spindle, i.e. the feed, alignment and clamping movement thereof, may thus be performed smoothly and with sensitively apportionable forces. Jerky relative movement of the centering spindles, as may occur in the above-described prior art for instance as a result of stick-slip effects in the lifting mechanism, is here ruled out by the ball screw, which in particular allows automatic, damage-free clamping of very small lenses by the ball clamp method.

The ball screw conveniently comprises a rotatably mounted roller ball spindle connected for drive with the electric motor, which spindle engages with a nut which is connected non-rotatably with a linearly guided clamping saddle. In an advantageously simple embodiment, at least one stay bolt is attached to the clamping saddle, at whose end remote from the clamping saddle there is attached the limit stop serving to absorb the moment arising at the rocking lever or forces resulting therefrom. In addition, the same stay bolt may also pass through and thus mount the above-mentioned compression spring of the spring mechanism, wherein a plate is guided longitudinally displaceably on the stay bolt on the side of the compression spring remote from the clamping saddle, which plate may optionally be brought into engagement with the rocking lever by means of the ball screw, in order to effect the above-described increase in clamping force.

An additional lever mechanism may be provided, by means of which the axially mobile centering spindle may be moved away manually from the centering spindle. This is particularly advantageous when lenses with very unfavourable centering angles are clamped between the centering spindles, where alignment relative to the centering spindle axis is possible only by hand. The additional lever mechanism conveniently acts on the rocking lever or the counterweight.

According to a third aspect of the present invention, in the case of a device for centering clamping of workpieces, in particular optical lenses, for edge machining thereof, having two aligned centering spindles arranged one above the other, which spindles are each constructed at their mutually facing ends to accommodate a bell clamp, wherein at least one centering spindle is guided axially in a centering spindle guide and may be moved in the axial direction relative to the other centering spindle by means of a lifting apparatus, in order to align and chuck the workpiece, provision is made for the centering spindle guide to comprise at least two linear guide units, which are arranged on each side of the axially mobile centering spindle in substantially play-free manner between the axially mobile centering spindle and a box-type structure surrounding it.

Thus, a smooth-running but nonetheless highly rigid centering spindle guide is provided for the device for centering clamping of workpieces, which ensures high precision of axial alignment for the centering spindles even under the action of external forces (e.g. machining forces in the event of grinding of the edge of a chucked lens). Because the linear guide units are arranged on each side of the axially mobile centering spindle, the centering spindle guide advantageously additionally exhibits thermally invariable behaviour in which thermal expansion is mutually compensated or supported relative to the box-type structure and thus does not impair the axial alignment of the centering spindles. Furthermore, the very compactly constructed box-type structure here replaces in a simple, assembly-friendly manner a complex cast gantry for the axially mobile centering spindle, which was necessary in the prior art, and additionally ensures boxing-in of the centering spindle guide, such that the latter is not susceptible to the effects of external dirt.

The axially mobile centering spindle can comprise a spindle housing and a spindle shaft mounted rotatably therein, wherein each linear guide unit has a carriage attached conveniently to the spindle housing, which carriage is guided on a respectively associated guide rail attached to the box-type structure.

Each carriage may be equipped with a plurality of ball chains, which run in respectively associated longitudinal channels in the corresponding guide rail. Such compact guides are commercially available bought-in components and are distinguished by their smooth running or lack of jerkiness, rigidity and low wear and maintenance.

Because the spindle housing may comprise, at least in part, a substantially rectangular external cross section, wherein a stop strip, extending parallel to the centering spindle axis, for the corresponding carriage is constructed on each opposing side face of the spindle housing, the linear guide units are easily aligned relative to the centering spindle axis.

In an advantageously simple embodiment, the box-type structure has four side walls preferably screwed together, which side walls define a cross-sectionally substantially rectangular cavity, in which the centering spindle guide is arranged. Measures can be provided which ensure in a simple manner, in the case of such an embodiment of the box-type structure, inter alia precise alignment of the guide rails relative to the centering spindle axis and lack of play in the centering spindle guide. Accordingly, the guide rails of the centering spindle guide are attached to opposing side walls of the box-type structure, wherein one of these side walls comprises a stop surface extending parallel to the centering spindle axis for the corresponding guide rail. The side walls themselves bearing the guide rails of the centering spindle guide are arranged between the other two side walls, whereby the box-type structure is very compact, wherein the other side walls in each case comprise only one stop strip extending parallel to the centering spindle axis for the same side wall bearing the corresponding guide rail. A fixed bearing is thus virtually produced both for one of the guide rails and for one of the guide rail side walls by the stop surface on the one guide rail side wall or the stop strips on the other side walls, while the other guide rail or the other guide rail side wall undergoes virtually movable bearing attachment without a limit stop, by means of which tolerances may be compensated, such that the centering spindle guide may be mounted in play-free manner. Angular offset between the axially mobile centering spindle and the other centering spindle is then ruled out in that the box-type structure is surface-ground on a bearing surface perpendicular to the centering spindle axis after assembly of the side walls, which bearing surface rests on a machine frame, which supports the other centering spindle.

The centering spindle guide can be conveniently equipped with a preferably contactless measuring system for a CNC control system, which comprises a slider attached to the axially mobile centering spindle together with a detection unit for the slider, fixed to the box-type structure. Thus, the contacting or clamping movement of the axially mobile centering spindle may be directly detected and sensitively controlled on the basis of the detected values. This measuring system may in principle be arranged inside the box-type structure. However, a more compact design is preferred, according to which the slider is attached to one of the carriages of the linear guide units with at least one stay bolt, which passes through an opening in a side wall of the box-type structure, on which the detection unit is arranged.

In an advantageous embodiment of the device according to the invention, one of the centering spindles is stationary in the axial direction and may be driven by means of a preferably CNC-controlled rotary actuator arranged concentrically to the centering spindle axis. The concentric arrangement of the rotary actuator has the advantage, on the one hand, that the device is very compact construction. On the other hand, high axial alignment precision of the centering spindles is ensured because, during drive of the stationary centering spindle, unilaterally acting transverse forces are no longer introduced thereinto from outside, as is the case with the gearing or belt drives according to the prior art. This rotary actuator can also conveniently drive the axially mobile centering spindle via a first gear pair, a vertical shaft and a second gear pair, optionally with the interposition of an apparatus for evening out the rotary movements of the centering spindles.

Finally, in the case of a machine for edge machining of workpieces with a clamping device according to the invention and at least one driven tool spindle, the tool spindle can extend parallel to the centering spindle axis to be offset angularly about the centering spindle axis relative to the linear guide units of the centering spindle guide. In this way, it is on the one hand ensured that the centering spindle guide does not spatially hamper the tool spindle or the guide thereof. On the other hand, it is thus possible to minimise the distance between centering spindle axis and tool spindle axis, such that for example lenses with very small diameters clamped between the centering spindles may also be machined at the edge, for which purpose, for instance, grinding wheels with small external diameters may be used. The use of small grinding wheels is desirable in any case for reasons of cost and weight.

In conclusion, it should be stated that, according to the invention, a device for centering clamping of workpieces is provided which, owing to the smooth running of centering spindle guide and lifting apparatus, the constantly guaranteed precise axial alignment of the centering spindles and the sensitively adjustable forces during alignment of the workpiece, allows for the first time even very small lenses for instance for endoscopic applications or the like possibly with unfavourable centering angles to be automatically aligned or clamped by the bell clamp method, without the lenses being damaged.

BRIEF DESCRIPTION OF THE DRAWINGS

The invention is described in more detail below with the aid of a preferred exemplary embodiment and with reference to the attached drawings, in which.

DESCRIPTION OF THE PREFERRED EMBODIMENT

Figure 1:
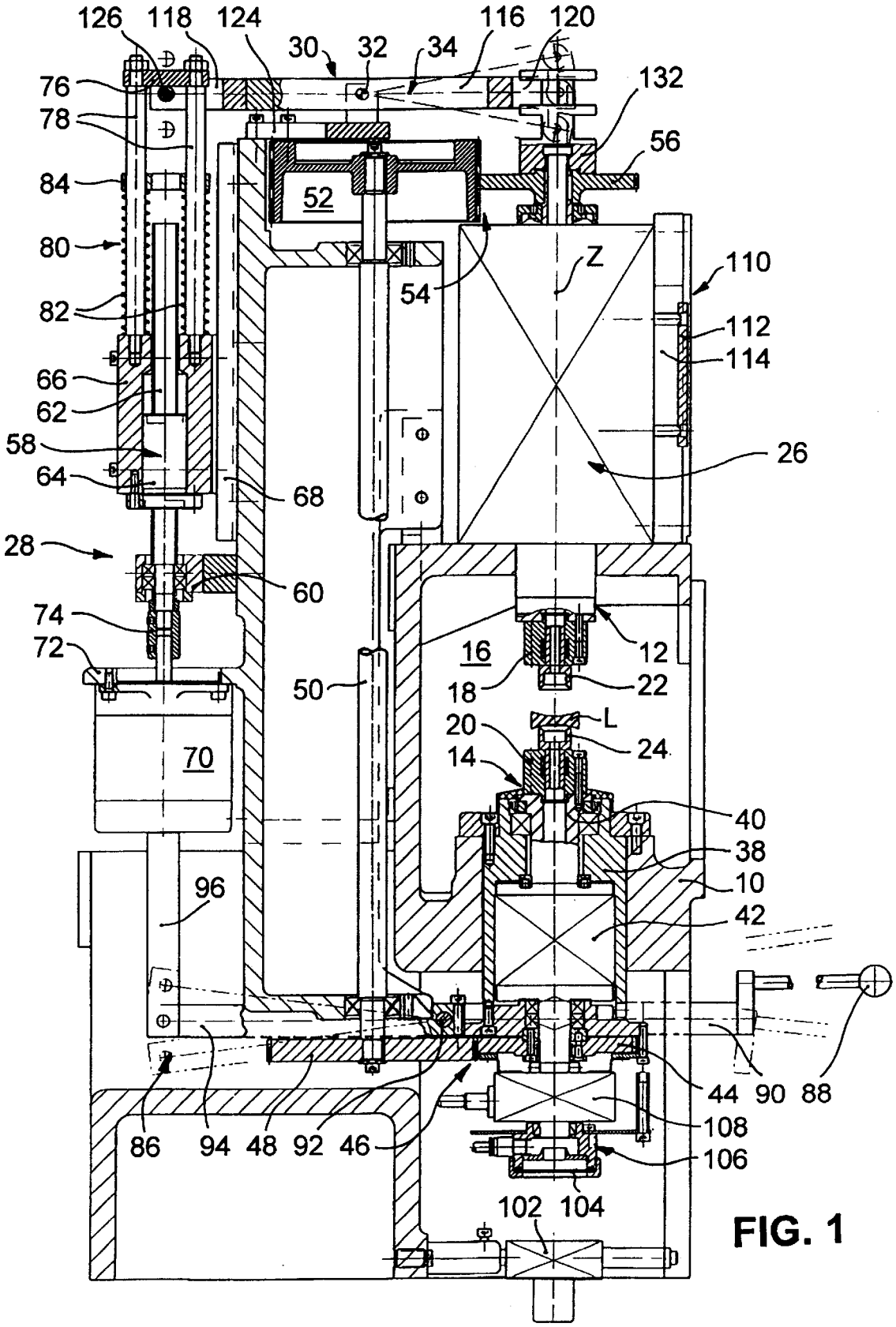
FIG. 1 is a partially sectional view of a device according to the invention for centering clamping of optical lenses as a component of a centering machine, which additionally comprises a device for edge machining of the lenses, which device is not shown in more detail here for reasons of clarity.

FIG. 1 shows a centering machine for optical lenses L, which comprises in a machine frame 10 a device, described below in detail, for centering clamping of the lens L and a device, not shown in more detail for reasons of clarity, for edge machining of the lens L once it is clamped. The device for centering clamping of the lens L has two centering spindles 12, 14 arranged one above the other in the machine frame 10 and aligned relative to a vertical centering spindle axis Z, which centering spindles 12, 14 each carry a chuck 18, 20 (each in this case being a hydraulic expansion chuck known per se) at their mutually facing ends in a machining space 16 each for accommodating a substantially cup-shaped bell clamp 22, 24 for the lens L. The upper centering spindle 12 is guided axially in a centering spindle guide 26 of particularly smooth-running but nonetheless rigid construction, which guide 26 is shown only schematically in FIG. 1 but which will be described in more detail with reference to FIGS. 5 and 6, and may be moved in the axial direction relative to the lower centering spindle 14 by means of a CNC-controlled lifting device 28, in order to align and clamp the lens L. The specially constructed lifting apparatus 28 is described in more detail below with reference to FIGS. 1 and 2.

Above the axially mobile upper centering spindle 12 there is provided a rocking lever mechanism 30, which will be described in more detail with reference to FIGS. 3 and 4, with a rocking lever 34 swivellable about a hinge point or hinge shaft 32, the upper centering spindle 12 being coupled to the right-hand end (in FIG. 1) of said lever 34 and two counterweights 36 visible in FIG. 2 being coupled to the left-hand end (in FIG. 1) of said lever 34, in order to generate a moment at the rocking lever 34 about the hinge point 32 which counteracts the moment generated by the upper centering spindle 12. In the exemplary embodiment shown, the masses of the counterweights 36 are so selected, in the case of a lever arm ratio of 1:1 at the rocking lever mechanism 30, that a small resultant moment acting in the clockwise direction in FIG. 1 is established at the rocking lever 34 about the hinge point 32.

The lower centering spindle 14 stationary in the axial direction has a spindle housing 38 attached non-rotatably in the machine frame, in which housing 38 a hollow spindle shaft 40 is mounted rotatably by means of radial bearings, the lower chuck 20 being attached to the upper end thereof in FIG. 1. In order to drive the two centering spindles 12, 14 rotationally for the aligning and clamping process and/or edge machining of the clamped lens L, a CNC-controlled rotary actuator 42, shown only schematically in FIG. 1, is additionally provided, which is arranged concentrically to the centering spindle axis Z. The stator of the rotary actuator 42 is fixed in the spindle housing 38 of the lower centering spindle 14, while its rotor is attached to the spindle shaft 40 of the lower centering spindle 14.

A gearwheel 44 of a first spur-toothed gear pair 46 is located on the spindle shaft 40 of the lower centering spindle 14 below the rotary actuator 42, which gearwheel 44 meshes with a gearwheel 48 attached to the lower end of a vertical shaft 50 mounted in the machine frame 10 by means of radial bearings. A relatively wide gearwheel 52 of a second spur-toothed gear pair 54 is attached to the upper end of the vertical shaft 50, which gearwheel 52 meshes with a gearwheel 56 attached to the upper end of the upper centering spindle 12. The gearwheel 56, made of low friction melamine resin, of the second gear pair 54 may be very easily displaced relative to the gearwheel 52 on the vertical shaft 50 upon axial movement of the upper centering spindle 12, without the gearwheels 52 and 56 moving out of engagement. Finally, a mechanism known per se but not illustrated here for reasons of clarity is provided in the gear train, consisting of the first gear pair 46, the vertical shaft 50 and the second gear pair 54, between the two centering spindles 12, 14, which mechanism ensures synchronous running of the two centering spindles 12, 14, i.e. prevents relative rotation of the upper centering spindle 12 relative to the lower centering spindle 14.

The lifting apparatus 28 for the upper centering spindle 12 acts on the left-hand end (in FIG. 1) of the rocking lever 34, to which the counterweights 36 are also coupled. It has a ball screw 58, comprising a roller ball spindle 62, which is mounted rotatably by means of radial bearings in a pillow block 60 attached to the machine frame 60 and engages with an associated nut 64. The nut 64 is connected non-rotatably with a clamping saddle 66, which is guided axially on a guide rail 68 extending parallel to the centering spindle axis 66 and attached to the machine frame 10. A CNC-controlled electric motor 70 is provided for driving the ball screw 58, which electric motor 70 is attached to a flange 72 of the machine frame 10 and is connected for drive to the roller ball spindle 62 by means of a clutch 74.

The lifting apparatus 28 additionally comprises an axially mobile limit stop in the form of a stop plate 76, which serves to absorb the moment arising at the rocking lever 34 about the hinge point 32 or forces resulting therefrom, as will be further described. Two stay bolts 78 extending upwards in parallel are attached to the upper surface (in FIGS. 1 and 2) of the clamping saddle 66, to whose ends remote from the clamping saddle 66 there is attached the stop plate 76, at a defined distance from the clamping saddle 66.

Finally, the lifting mechanism 28 also comprises a spring mechanism 80, via which a defined additional force may be applied by means of the rocking lever mechanism 30 to the upper centering spindle 12 in the direction of the lower centering spindle 14, as will also be further explained. The spring mechanism 80 comprises two helical compression springs 82, connected in parallel, with preferably linear spring characteristics, through which the stay bolts 78 pass, and a pressure plate 84, which is guided in longitudinally displaceable manner on the stay bolts 78 on the side of the compression springs 82 remote from the clamping saddle 66 and may optionally be brought into active connection with the rocking lever mechanism 30 by means of the ball screw 58.

Figure 2:
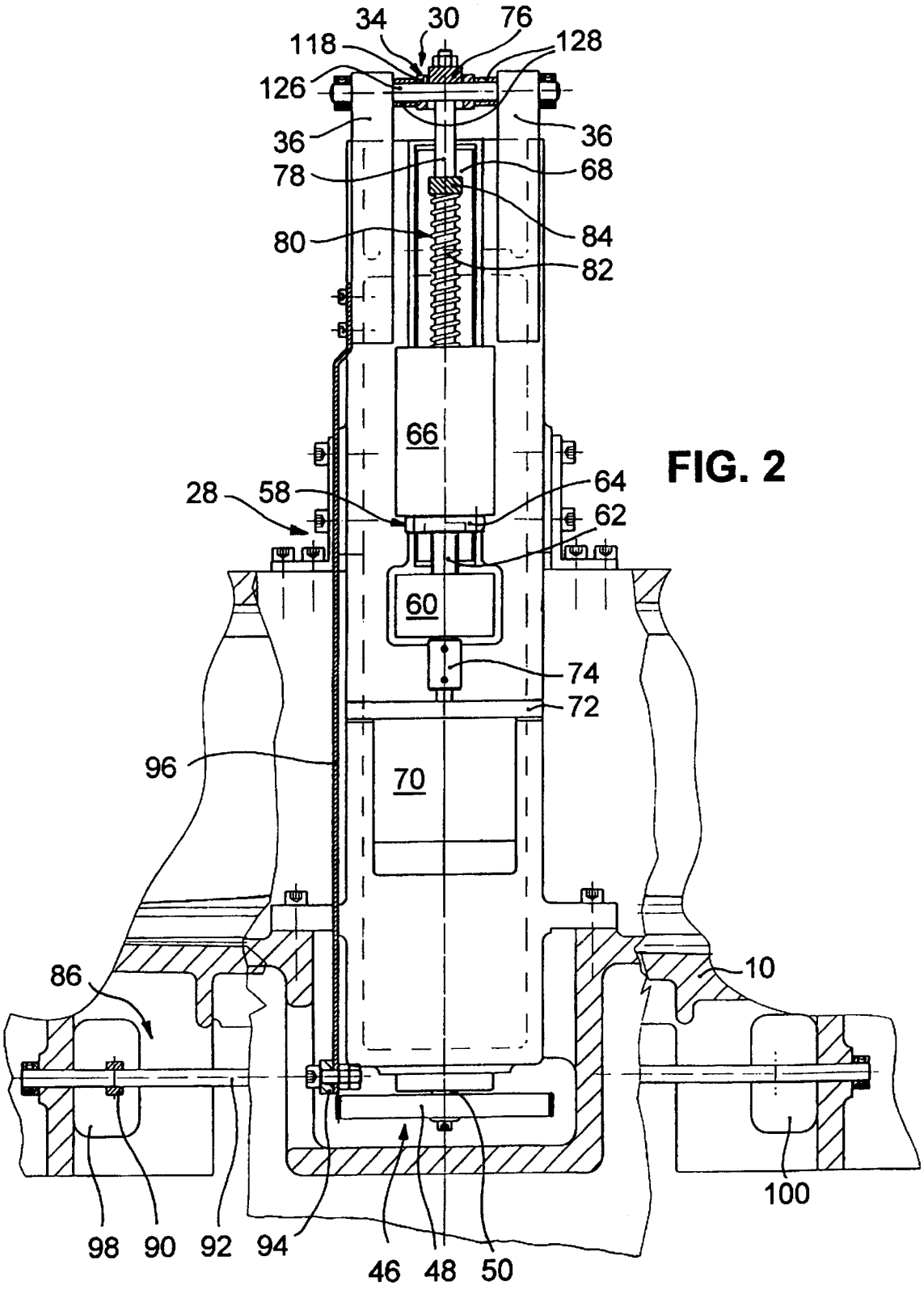
FIG. 2 is a broken-away, partially broken-open side view of the device according to FIG. 1, from the left in FIG. 1, showing in particular a lifting device for an axially mobile centering spindle.

FIGS. 1 and 2 also show an additional lever mechanism 86 of the device for centering clamping of the lens L, by means of which the upper centering spindle 12 may be moved manually away from the lower centering spindle 14. The additional lever mechanism 86 has an arm 90 provided with a handle 88, which arm 90 is attached to a shaft 92 mounted in the machine frame 10, such that the shaft 92 may be turned by means of the arm 90. A further arm 94 is attached to the shaft 92 in the vicinity of the spindle housing 38 of the lower centering spindle 14, to whose end remote from the shaft 92 there is coupled a rod 96, which is in turn connected with the counterweight 36 on the left in FIG. 2. It is obvious that swivelling of the arm 90 in FIG. 1 upwards or anti-clockwise about the axis of the shaft 92 effects a downward movement of the arm 94 and thus of the rod 96, such that the counterweights 36 are drawn downwards, whereby the upper centering spindle 12 is raised via the rocking lever mechanism 30. As indicated in FIG. 2, the arm 90 of the additional lever mechanism 86 passes with its end carrying the handle 88 through an opening 98 on the left-hand side, in FIG. 2, of the machine frame 10. FIG. 2 also shows an opening 100 for the arm 90, corresponding to the opening 98, on the other side, i.e. the right-hand side in FIG. 2, of the machine frame 10, which allows the arm 90, carrying the handle 88, of the additional lever mechanism 86 to be attached to the shaft 92, in accordance with the respective requirements, for right-handed or left-handed manual actuation or for arms 90 to be attached to the shaft 92 on both sides.

On the lower centering spindle 14, FIG. 1 also shows a detection unit 102 for a laser alignment system, not shown in any more detail, a vacuum connection 106 closed with a glass sheet 104 and a rotary transducer 108 for CNC control of the rotary actuator 42, while a measuring system 110 inter alia for CNC control of the lifting apparatus 28 is shown on the centering spindle guide 26, which measuring system 110 comprises a slider 112 movable with the upper centering spindle 12 and a detection unit 114 for the slider 112 and stationary in relation thereto.

The laser alignment system has a laser (not shown) arranged above the upper centering spindle 12, by means of which a laser beam may be directed in a manner known per se through the hollow upper centering spindle 12 along the centering spindle axis Z, which laser beam then impinges on the lens L and, if the lens L is not in a centred position, is deflected thereby in such a way that it passes further at an angle to the centering spindle axis Z through the hollow spindle shaft 40 of the lower centering spindle 14 and the vacuum connection 106 until it finally impinges on the detection unit 102, by means of which the angular deviation relative to the centering spindle axis Z is detected. It is thus possible to determine or monitor, for the alignment process of the lens L, the deviation of the optical from the mechanical axis of the lens L.

Finally, a regulated negative pressure may be applied in a manner likewise known per se by means of the vacuum connection 106 to the hollow spindle shaft 40 of the lower centering spindle 14, in order to attach the lens L by suction against the lower bell clamp 24, in particular in the case of a manual alignment process.

Figure 3:
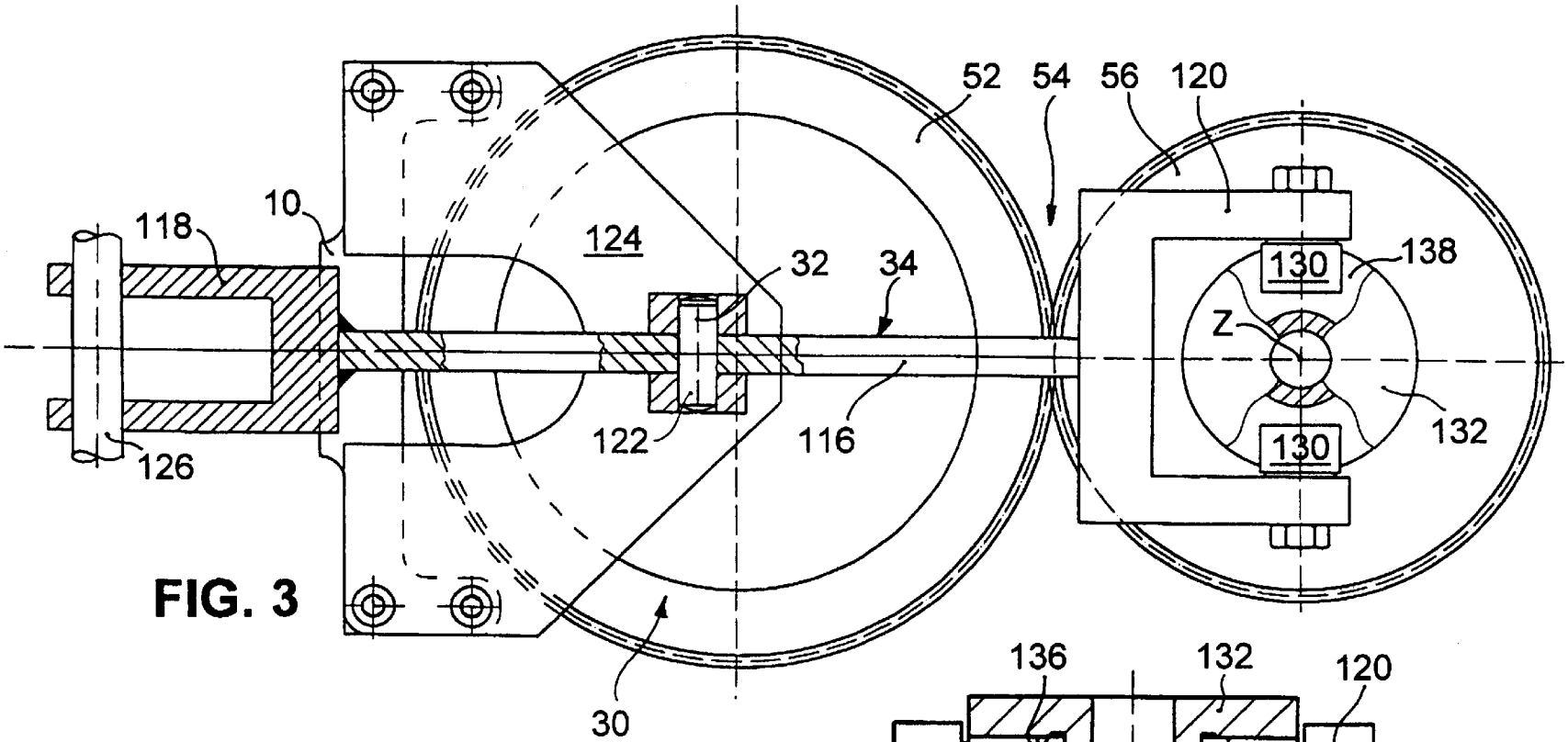
FIG. 3 is a broken-away, partially broken-open plan view of the device according to FIG. 1, showing in particular details of a rocking lever mechanism arranged between the lifting apparatus and the axially mobile centering spindle.
Figure 4:
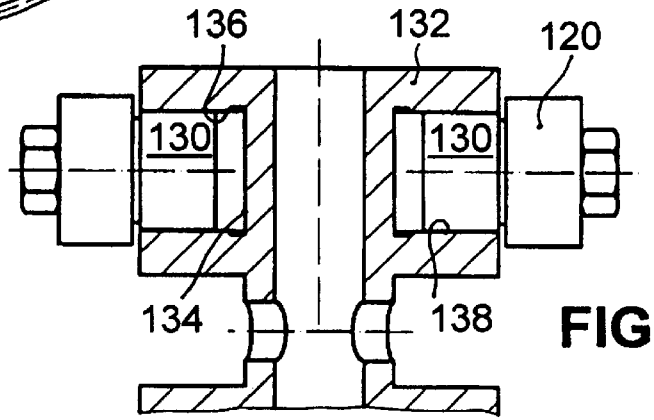
FIG. 4 is an enlarged, partially broken-open side view of the rocking lever mechanism, from the right in FIG. 3, showing the connection of the axially mobile centering spindle to the rocking lever mechanism.

FIGS. 3 and 4 show further details of the rocking lever mechanism 30. The rocking lever 34 has a cross-sectionally rectangular, bar-shaped central part 116, at each end of which there is attached a forked portion 118, 120, and is mounted swivellably on a pillow block 124 at the hinge point 32 by a pin 122 passing through the central part 116, the pillow block 124 in turn being attached to the machine frame 10.

At the open end of the forked portion 118 on the left-hand side, i.e. the lifting mechanism side, in FIG. 3, there is likewise provided a pin 126, which passes through the forked portion 118 and to which, as only FIG. 2 shows, the counterweights 36 are attached on both sides of the forked portion 118, wherein the counterweights 36 are spaced from the forked portion 118 in a defined manner by means of distance sleeves 128 positioned on the pin 126, in order not to hamper the movements of the lifting mechanism 28. According to FIGS. 1 and 2, the stay bolt 78 attached to the clamping saddle 66 on the right-hand side in FIG. 1 extends through the forked portion 118 of the rocking lever 34, while the stay bolt 78 on the left-hand side in FIG. 1 is spaced from the forked portion 118 in the transverse direction, such that the pin 126 passes through between the stay bolts 78 in the area of the forked portion 118 beneath the stop plate 76 of the lifting apparatus 28 and above the pressure plate 84 of the spring mechanism 80.

As a result, when the device for centering clamping of the lens L is in the position shown in FIG. 1, in which the upper bell clamp 22 is spaced from the lens L positioned on the lower bell clamp 24, the pin 126 may strike the stop plate 76, whereas, when the lifting apparatus 28 moves upwards in FIG. 1, it moves free of the stop plate 76, when the upper bell clamp 22 of the lowered upper centering spindle 12 comes into contact with the lens L, until finally the pressure plate 84 strikes against the pin 126 from below upon further upwards displacement, in FIG. 1, of the lifting apparatus 28.

Rollers 130 are mounted rotatably by means of ball bearings, not shown, on journals, likewise not shown, on the forked portion 120 of the rocking lever 34 on the right-hand side in FIG. 3, i.e. the centering spindle side, on the mutually facing side faces of the forked portion 120. The rollers 130 engage with a drive flange 132 attached to the upper centering spindle 12 or the gearwheel 56. To this end, the drive flange 132, which takes the form of a hollow rotary element, comprises a circumferential channel 134, which accommodates the rollers 130 with slight radial play (not shown). According to FIG. 4, the channel 134 comprises an upper annular surface 136 and a lower annular surface 136, wherein the rollers 130 may roll on the upper annular surface 136 when the upper bell clamp 22 is spaced from the lens L positioned on the lower bell clamp 24, i.e. the upper centering spindle 12 is suspended with the drive flange 132 on the forked portion 120 of the rocking lever 34, and wherein the rollers 130 may roll on the lower annular surface 138 when the upper bell clamp 22 is pressed against the lens L by means of the spring mechanism 80 of the lifting apparatus 28, i.e. the pressure plate 84 of the spring mechanism 80 presses from below against the pin 126 on the forked portion 118 of the rocking lever 34, in FIGS. 1 and 2.

As a result, the drive flange 132 may rotate together with the upper centering spindle 12 relative to the forked portion 120 of the rocking lever 34. Moreover, the rocking lever 34 and the upper centering spindle 12 may form different angles with one another in the event of swivelling of the rocking lever 34 about the hinge point 32 and an unchanged relative position between hinge point 32 and centering spindle axis Z, as indicated by dashed lines in FIG. 1, without its being possible to introduce transverse forces possibly detrimental to the precise axial alignment of the centering spindles 12, 14 into the upper centering spindle 12 via the active connection thus formed between rocking lever 34 and upper centering spindle 12. In other words, only those forces whose active lines run parallel to the centering spindle axis Z may be introduced by the rocking lever 34 into the upper centering spindle 12 and vice versa via the active connection thus formed between rocking lever 34 and upper centering spindle 12.

Figure 6:
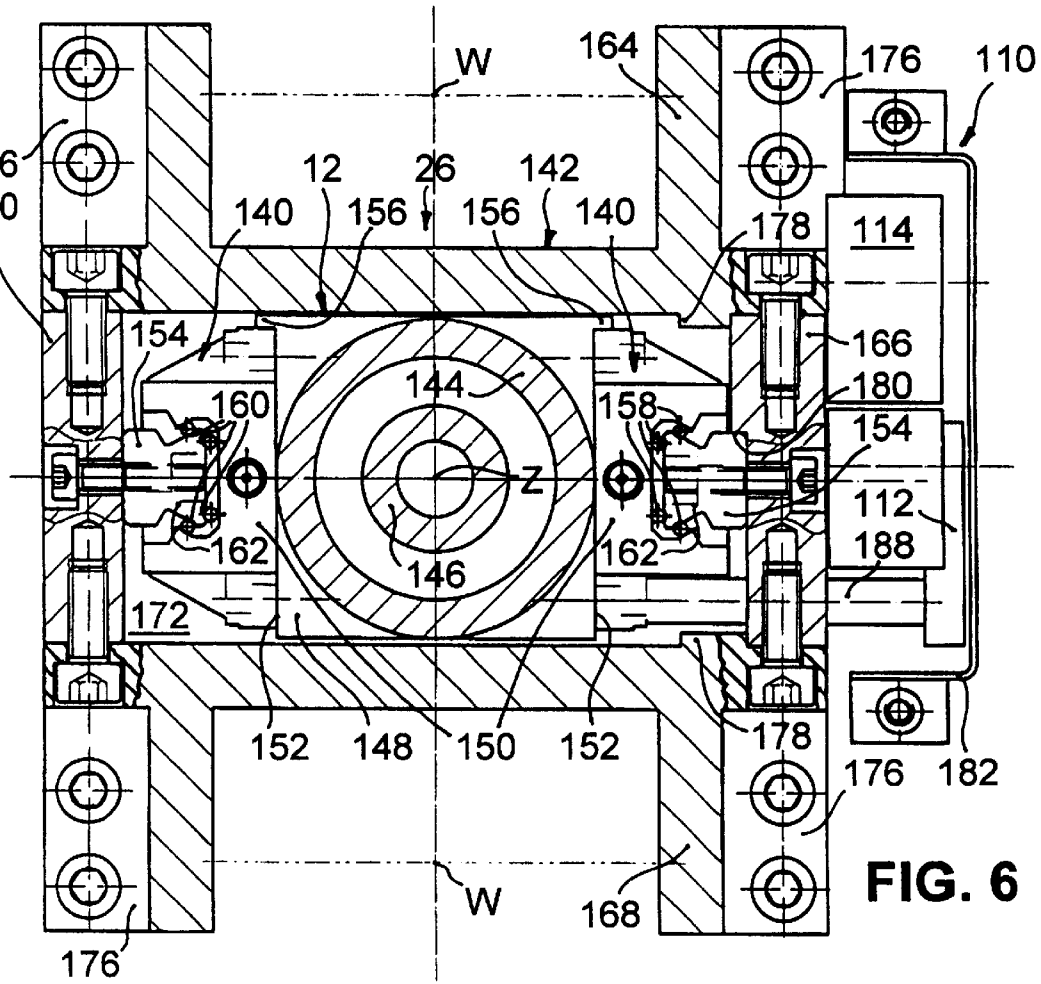
FIG. 6 is an enlarged sectional view of the centering spindle guide along line VI—VI in FIG. 5 and FIGS. 7 to 9 are basic representations of the device according to the invention, illustrating the aligning and clamping process of an optical lens.
Figure 5:
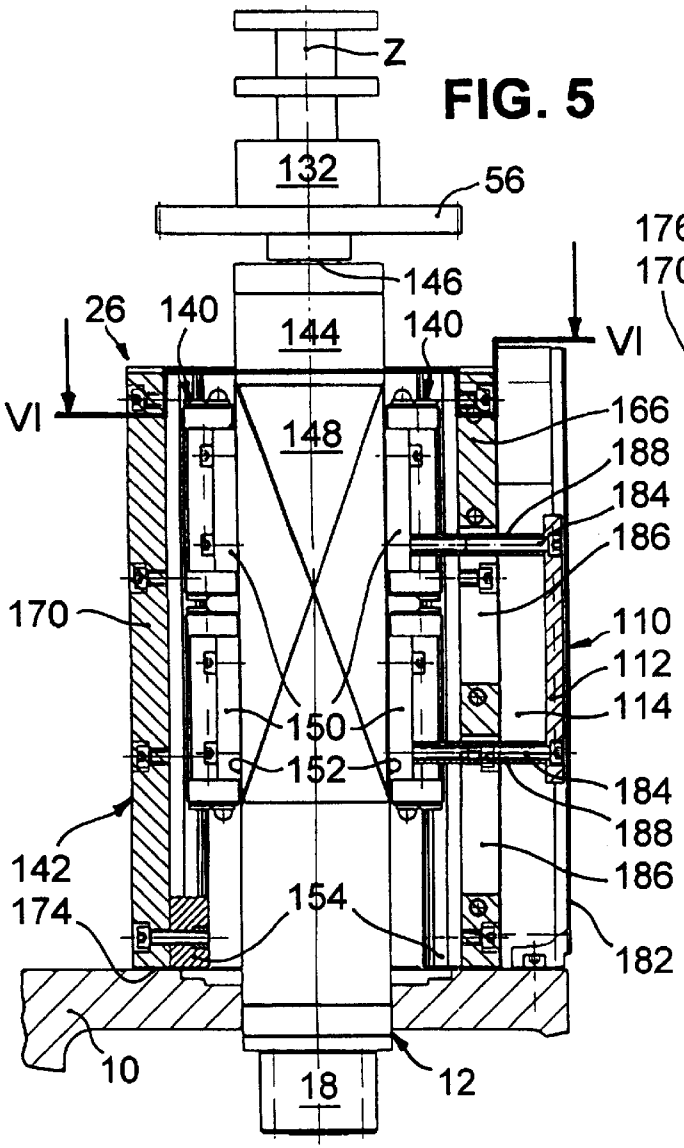
FIG. 5 is a partially sectional view of a centering spindle guide for the axially mobile centering spindle of the device according to FIG. 1.

FIGS. 5 and 6 show details of the centering spindle guide 26 for the upper centering spindle 12. In the embodiment shown, the centering spindle guide 26 comprises two linear guide units 140, which are arranged on each side of the upper centering spindle 12 in substantially play-free manner between the upper centering spindle 12 and a box-like structure 142 surrounding the latter. As is particularly clear from FIG. 6, the upper centering spindle 12 also has a spindle housing 144 and a hollow spindle shaft 146 mounted rotatably therein by means of radial bearings (not shown). The spindle housing 144 comprises a portion 148 with a substantially rectangular external cross section (indeed, in the embodiment shown, a square external cross section), which is marked in FIG. 5 with a cross, and is otherwise of hollow-cylindrical construction. In the embodiment shown, each of the linear guide units 140 has two identically constructed carriages 150, which are attached by means of screws to opposing side faces 152 in the area of the rectangular portion 148 of the spindle housing 144 and are in each case guided on an associated guide rail 154 attached to the box-type structure 142 by means of screws, which guide rail 154 extends approximately over the entire length of the box-type structure 142. So that the carriages 150 assume a defined relative position relative to the spindle housing 144 and thus the spindle shaft 145, a stop strip 156 extending parallel to the centering spindle axis Z is provided in each case for the corresponding carriage 150 at the upper ends, in FIG. 6, of the opposing side faces 152 of the spindle housing 144.

The carriages 150 and the guide rails 154 are commercially available bought-in components or elements. In the embodiment shown, each of these carriages 150 is equipped with four lubricated ball chains 158, which extend in respectively associated longitudinal channels 160 in a cross-sectionally dovetail-shaped portion 162 of the corresponding guide rail 154. It is obvious that although the arrangement of the longitudinal channels 160 on the dovetail-shaped portion 162 of the guide rail 154 and the corresponding distribution of the ball chains 158 on the respective carriage 150 relative to the guide rail 154 allows longitudinal movement of the carriage 150 parallel to the centering spindle axis Z, such arrangement does not allow relative movement of the carriage 150 to the right or left or upwards or downwards in FIG. 6.

As FIG. 6 further shows, the box-type structure 142 comprises four screwed-together side walls 164, 166, 168 and 170, which define a cross-sectionally substantially rectangular cavity 172, in which the centering spindle guide 26 is arranged.

The side walls 164, 168, shown at the top and bottom in FIG. 6, of the box-type structure 142 have in cross section substantially the shape of a double-webbed T-section and are each provided in the area of a bearing surface 174 shown in FIG. 5, via which the box-type structure 142 rests on the machine frame 10, externally, i.e. to the right and left in FIG. 6, with fastening flanges 176, by means of which the box-type structure 142 is screwed to the machine frame 10. Each of the side walls 164 and 168 is additionally provided in the area of the cavity 172 with a stop strip 178 extending parallel to the centering spindle axis Z for the side wall 166 to the right in FIG. 6.

The side walls 166 and 170 of the box-type structure 142 shown to the right and left in FIGS. 5 and 6 and exhibiting a substantially rectangular cross section are slightly wider than the rectangular portion 148 of the spindle housing 144 and arranged between the side walls 164 and 168, such that the rectangular portion 148 of the spindle housing 144 is accommodated in the cavity 172 at only a slight distance from the side walls 164 and 168. The guide rails 154 of the centering spindle guide 26 are attached to the mutually facing side faces of the side walls 166 and 170, wherein the right-hand side wall 166 (in FIG. 6) is provided with a step, which forms a stop surface 180, extending parallel to the centering spindle axis Z, for the corresponding guide rail 154.

The above-described structure of the centering spindle guide 26 results in the existence of a defined positional relationship between the box-type structure 142, the linear guide units 140 and the centering spindle axis Z and in the possibility of mounting the centering spindle guide 26 in substantially play-free manner. The carriages 150 of the linear guide units 140 are oriented towards the side faces 152 and the stop strips 156 of the spindle housing 144 relative to the centering spindle axis Z, the guide rails 154 are oriented towards the carriages 150, the side wall 166 of the box-type structure 142 is oriented via the stop face 180 towards the right-hand guide rail 154, in FIG. 6, and the side walls 164 and 168 are oriented via the stop strips 178 towards the side wall 166, such that finally, by stop-less insertion of the side wall 170 between the side walls 164 and 168, substantially play-free, highly rigid axial guidance is obtained for the upper centering spindle 12. The precise axial alignment between the upper centering spindle 12 and the lower centering spindle 14 is then established during mounting of the box-type structure 142 on the machine frame 10, after it has been ensured, by surface-grinding of its bearing surface 174 perpendicularly to the centering spindle axis Z, that there is no angular offset between the upper centering spindle 12 and the lower centering spindle 14.

FIGS. 5 and 6 additionally show the contactless measuring system 110, already mentioned above with reference to FIG. 1, for the CNC control system, the slider 112 and detection unit 114 of which are protected by a cover 182 attached to the machine frame 10. The slider 112 is attached to the carriage 150 of the linear guide unit 140 on the right-hand side in FIG. 5 by means of stay bolts 184, which pass through oblong openings 186 in the side wall 166 of the box-type structure 142 and distance sleeves 188. The detection unit 114, on the other hand, is attached to the side of the side wall 166 remote from the cavity 172.

It has already been mentioned above that the device described for centering clamping of lenses L is a component of a lens centering machine, which also comprises a device for edge machining of the lenses L, namely for centering edge grinding and bevelling of the lenses L. Of the latter, FIG. 6 shows the axes W, extending parallel to the centering spindle axis Z, of the two driven tool spindles, not shown in any more detail, which are each constructed to accommodate a tool which may optionally be brought into engagement with the lens L, which tool is likewise not shown. The tool spindle axes W are arranged symmetrically between the webs of the side walls 164 and 168, cross-sectionally in the form of a double-webbed T-section, of the box-type structure 142, i.e. offset angularly by 90° about the centering spindle axis Z relative to the linear guide units 140 of the centering spindle guide 26. As a result, in the case of the above-described construction of the centering spindle guide 26, the tool spindle axes W are brought very close to the centering spindle axis Z, such that small lenses L may be machined at the edge with small milling or grinding tools.

The mode of operation of the above-described device for centering clamping of lenses L is explained in more detail below with reference to FIGS. 7 to 9, which show a simplified representation of the clamping device of the centering machine with its essential components.

First of all, the lens L is positioned on the lower bell clamp 24 accommodated in the chuck 20 of the stationary lower centering spindle 14. This may be performed manually or automatically with a charging system, not shown, which may easily reach into the machining space 16 and between the centering spindles 12, 14 owing to the vertical construction of the clamping device.

Figure 7:
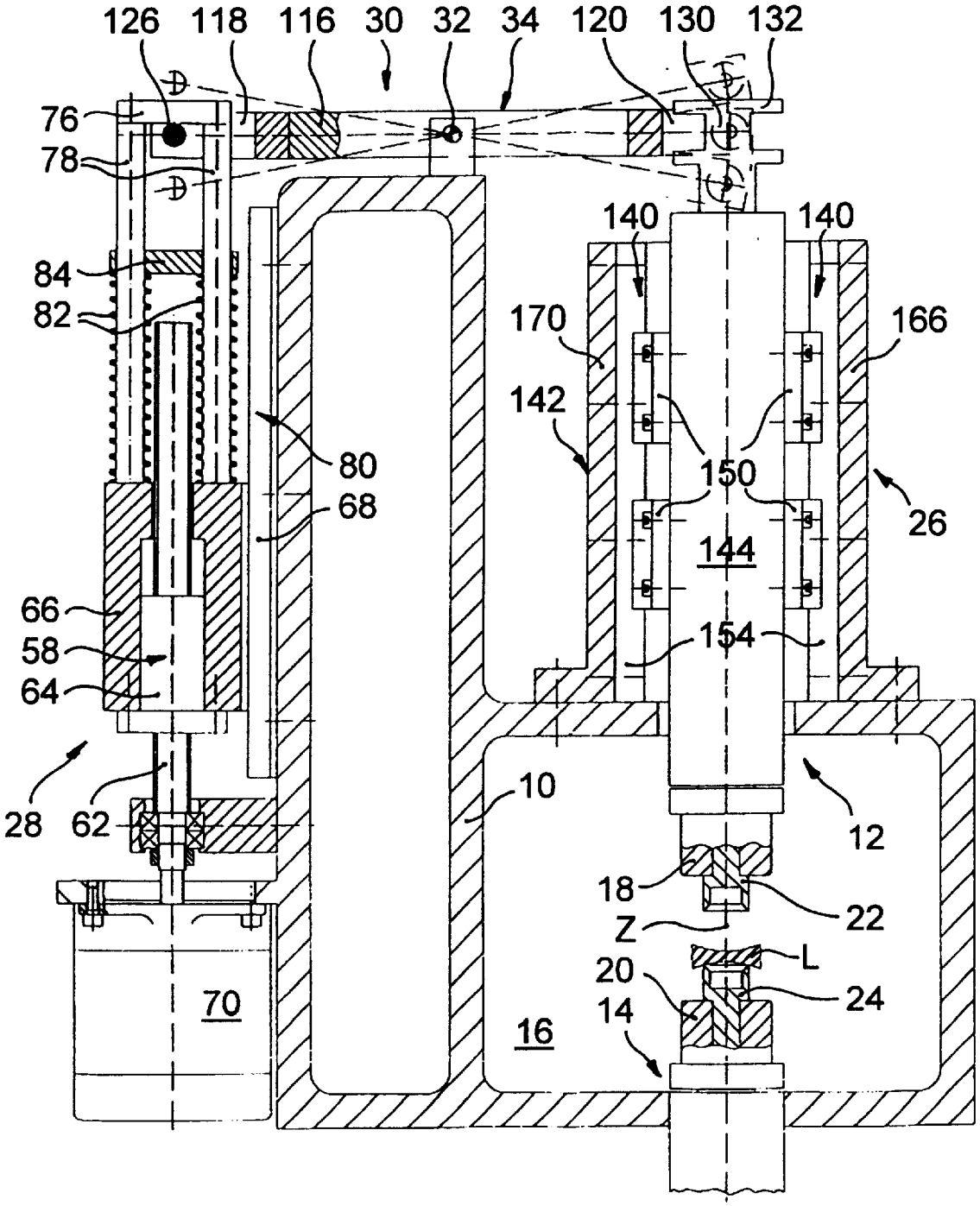

As may readily be seen in FIG. 7, in this basic position of the clamping device the upper bell clamp 22 accommodated in the chuck 18 of the mobile upper centering spindle 12 is spaced from the lens L by a predetermined amount. The upper centering spindle 12 guided in smooth-running manner in the box-type structure 142 of the centering spindle guide 26 in the direction of the centering spindle axis Z by means of the mutually parallel linear guide units 140 arranged equidistantly from the centering spindle axis Z is suspended with the drive flange 132 on the rollers 130, which are attached to the forked portion 120 of the rocking lever 34. On the other side of the rocking lever mechanism 30, the counterweights 36 suspended on the forked portion 118 of the rocking lever 34 by means of the pin 126 counteract the weight of the upper centering spindle 12. In the exemplary embodiment described, a small moment arises in the clockwise direction about the hinge point 32, which is opposed by the stop plate 76 on the stay bolts 78 attached to the clamping saddle 66 of the lifting apparatus 28. As a result of the form-fitting engagement between the nut 64 of the ball screw 58 attached to the clamping saddle 66 and the roller ball spindle 62, the clamping saddle 66 stands still when the electric motor is not actuated and supports the force applied in an upwards direction in FIG. 7 on the stop plate 76.

From this basic position, the electric motor 70 is actuated by means of the CNC control system, not shown. Through the thus effected rotation of the roller ball spindle 62 relative to the nut 64, the clamping saddle 66, guided on the guide rail 68 on the machine frame 10, of the lifting apparatus 28 is raised. The rocking lever 34 lying with the pin 126 against the stop plate 76 moving upwards in FIG. 7 follows the movement of the lifting apparatus 28 as a result of the moment arising in a clockwise direction about the hinge point 32, for which reason, on the other side of the rocking lever mechanism 30, the upper centering spindle 12 moves downwards towards the lens L until the upper bell clamp 22 lies against the lens L with a slight force which may be preselected in a defined manner by means of the lever arm ratio at the rocking lever 34 or the mass of the counterweights 36. As the clamping saddle 66 of the lifting apparatus 28 moves further upwards, the rocking lever 34 then moves out of engagement with the stop plate 76 or the stop plate 76 moves upwards away from the pin 126 of the rocking lever 34. This situation is illustrated in FIG. 8.

Figure 8:
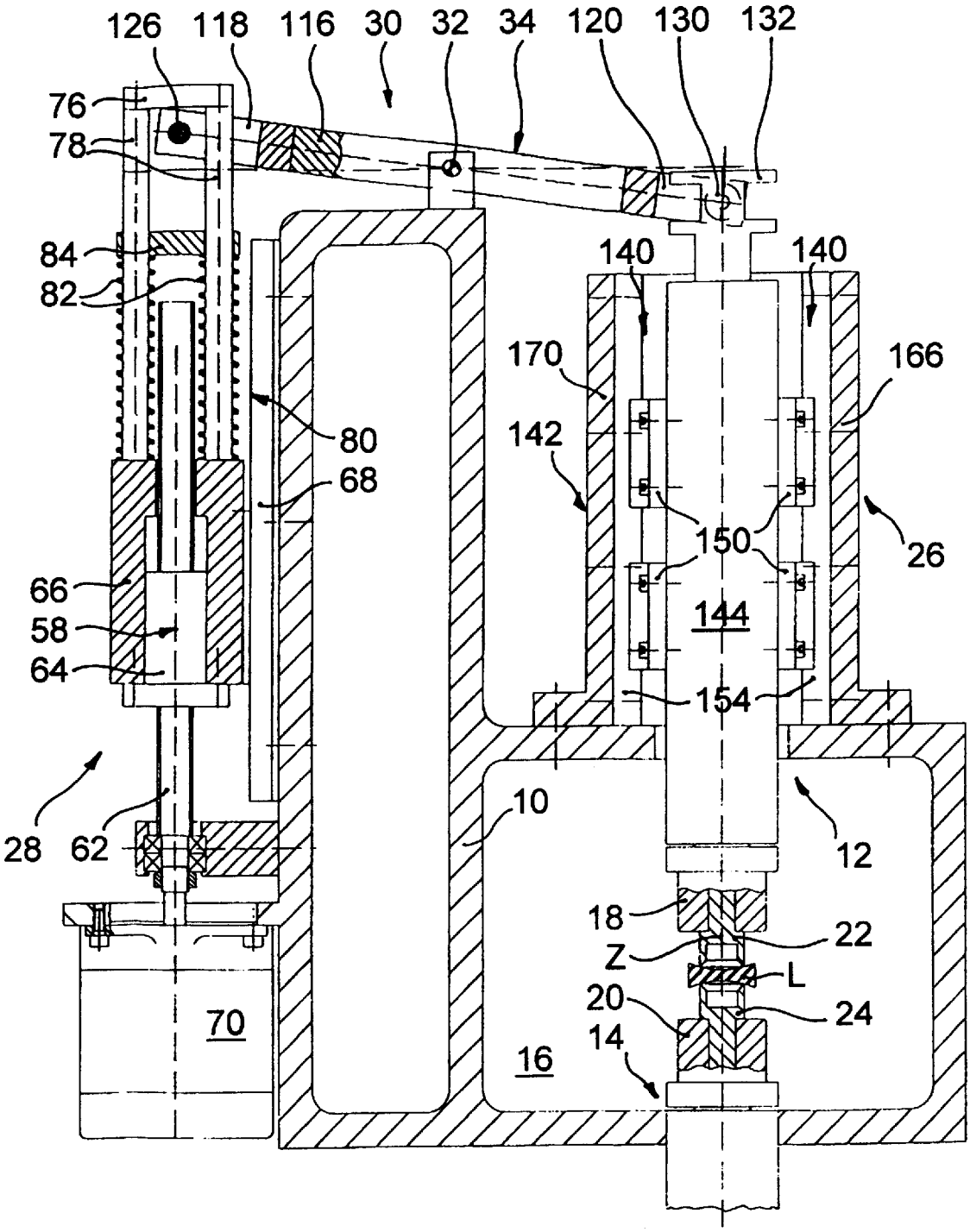
Figure 9:
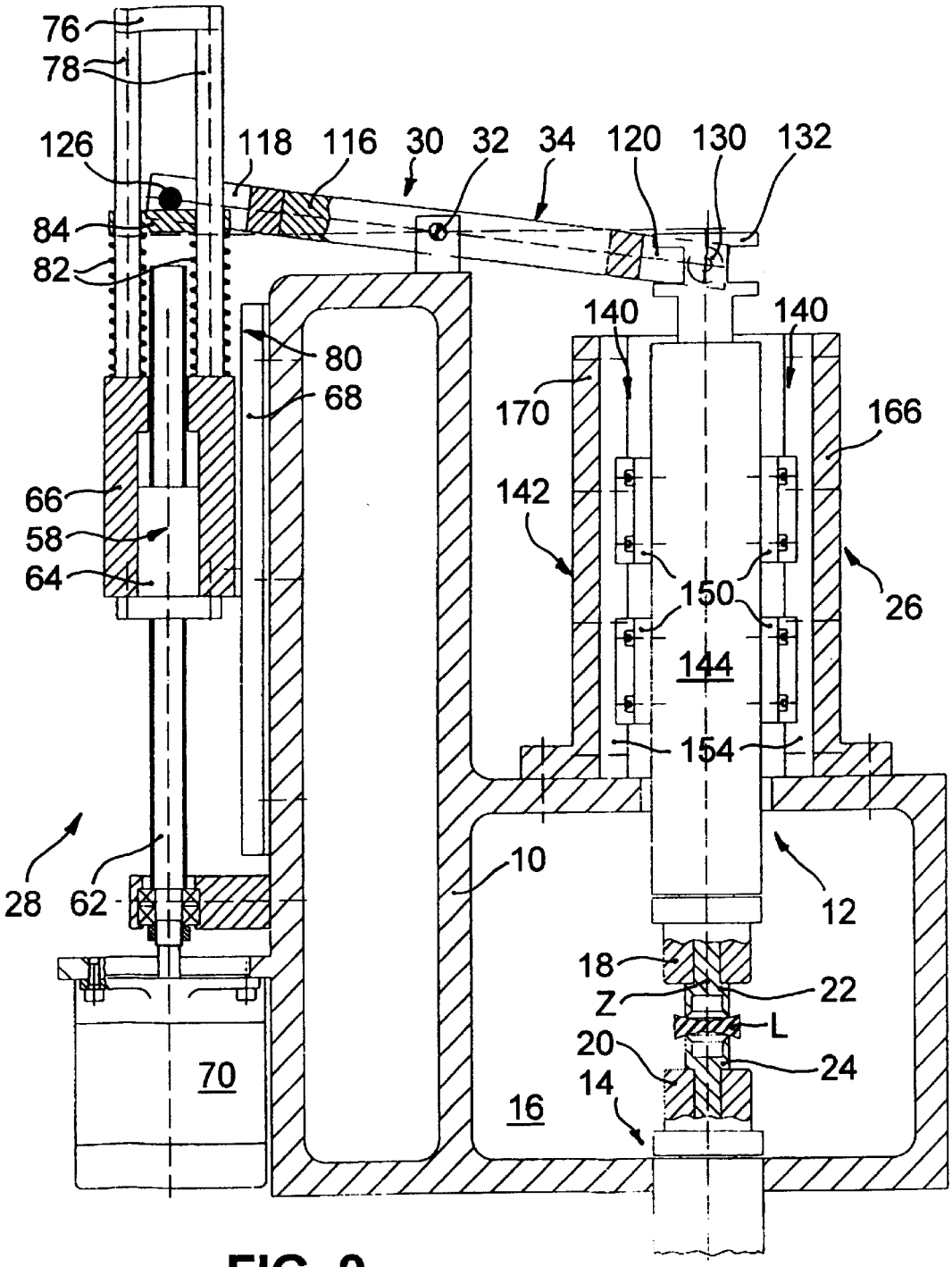

During movement of the clamping device between the basic position illustrated in FIG. 7 and the middle position illustrated in FIG. 8, the bell clamp process already described above occurs, in which the lens L and its optical axis are automatically aligned relative to the centering spindle axis and preliminarily clamped between the bell clamps 22, 24 of the centering spindles 12, 14. Under the slight pressure of the upper bell clamp 22 coming into contact with the lens L, the lens L moves automatically in the transverse direction as a result of the curvature of its optical surfaces, optionally with the addition of a suitable lubricant and/or rotation of the centering spindles 12, 14, wherein the bell clamps 22, 24 move closer together until the lens L has assumed a position between the bell clamps 22, 24 which allows the minimum distance between the bell clamps 22, 24 under the given geometric circumstances. The lens L, now with its optical axis aligned relative to the centering spindle axis Z and preliminarily clamped as a result of the small moment arising at the rocking lever mechanism 30 in a clockwise direction about the hinge point 32 may now be clamped firmly between the bell clamps 22, 24 for edge machining purposes.

To this end, the clamping saddle 66 of the lifting apparatus 28 is raised further, starting from the middle position shown in FIG. 8, by means of the driven ball screw 58 until the pressure plate 84 supported via the compression springs 82 of the spring mechanism relative to the clamping saddle 66 contacts the pin 126 on the rocking lever 34 from below. Further upwards displacement of the clamping saddle 66 now results in compression of the compression springs 82, whereby the moment arising at the rocking lever mechanism 30 in a clockwise direction about the hinge point 32 is increased and the upper bell clamp 22 is pressed against the lens L with a defined additional force via the upper centering spindle 12. As a result, the lens L is chucked so firmly that transverse forces acting on the lens L during edge machining cannot displace the lens L out of its axially aligned position. This clamping position of the device is illustrated in FIG. 9.

Once edge machining is complete, first of all the additional clamping force acting on the lens L is removed through reverse driving of the ball screw 58, which results in a downwards movement of the clamping saddle 66 of the lifting apparatus 28, the compression springs 82 of the spring mechanism 80 being released, then the pin 126 on the rocking lever 34 effects its dead travel between the pressure plate 84 and the stop plate 76 until finally the upper centering spindle 12 is withdrawn from the lens L by means of the rocking lever mechanism 30 via the stop plate 76 pressing downwards on the pin 126 of the rocking lever 34 and the edge-machined lens L may be removed.

All that remains to be mentioned in this connection is that the dead travel, clear from FIGS. 7 and 8, between the bottom of the pin 126 and the top of the pressure plate 84 may be overcome by means of the additional lever mechanism 86 explained above with reference to FIGS. 1 and 2, i.e. the upper centering spindle 12 may be moved away from the lens L lying on the bell clamp 24 of the lower centering spindle 14 by this distance by means of the additional lever mechanism, for instance so that the lens L may be aligned/moved by hand. Further explanations on this point would seem unnecessary.

Accordingly, a device is disclosed for centering clamping in particular of lenses, which comprises two aligned centering spindles, arranged one above the other, with bell clamps. One centering spindle is guided axially in a centering spindle guide and may be moved relative to the other centering spindle by means of a lifting apparatus. So that a smooth, sensitively adjustable clamping movement is achieved with precise axial alignment of the centering spindles, which movement allows clamping of small lenses by the bell clamp method, a swivellable rocking lever is provided, to which the mobile centering spindle and a counterweight are coupled on opposing sides, the lifting apparatus is provided with an electric motor-driven ball screw, which may raise or lower the mobile centering spindle and/or the centering spindle guide is equipped with linear guide units, which are arranged on each side of the mobile centering spindle in substantially play-free manner between the latter and a box-type structure.

We claim:

1. A device for centering clamping of workpieces, in particular optical lenses, for machining of the edges thereof, having two aligned centering spindles arranged one above the other, which spindles each have mutually facing ends constructed to accommodate a bell clamp, wherein at least one centering spindle is guided axially in a centering spindle guide and may be moved in the axial direction relative to the other centering spindle by means of a lifting apparatus, in order to align and chuck the workpiece; wherein a swivellable rocking lever is provided with one end to which there is coupled the axially mobile centering spindle and with another end to which there is coupled at least one counterweight, in order to produce a moment at the rocking lever which counteracts the moment produced by the axially mobile centering spindle.

2. A device according to claim 1, wherein the rocking lever is arranged above the axially mobile upper centering spindle.

3. A device according to claim 1, wherein the rocking lever has a forked portion, on which rollers are rotatably mounted, which engage with a drive flange attached to the axially mobile centering spindle.

4. A device according to claim 1, wherein the lifting apparatus acts on the end of the rocking lever to which the counterweight is coupled.

5. A device according to claim 1, wherein the lifting apparatus comprises a limit stop movable in the axial direction, which limit stop serves to absorb the moment arising at the rocking lever or forces resulting therefrom.

6. A device according to claim 1, wherein the lifting apparatus has a spring mechanism, by means of which a defined, additional force may be applied to the axially mobile centering spindle in the direction of the other centering spindle.

7. A device according to claim 6, wherein the spring mechanism comprises at least one compression spring.

8. A device according to claim 1, wherein the lifting apparatus comprises a ball screw drivable by means of an electric motor, which ball screw serves to move one centering spindle relative to the other centering spindle in the axial direction, preferably under CNC control, in order to align the workpiece and also chuck it.

9. A device according to claim 8, wherein the ball screw comprises a rotatably mounted roller ball spindle connected for drive with the electric motor, which spindle engages with a nut which is connected non-rotatably with a linearly guided clamping saddle.

10. A device according to claim 9, wherein at least one stay bolt is attached to the clamping saddle, at whose end remote from the clamping saddle there is attached the limit stop serving to absorb the moment arising at the rocking lever or the forces resulting therefrom.

11. A device according to claim 10, wherein the stay bolt passes through the compression spring of the spring mechanism, wherein a plate is guided longitudinally displaceably on the stay bolt on the side of the compression spring remote from the clamping saddle, which plate may optionally be brought into engagement with the rocking lever by means of the ball screw.

12. A device according to claim 1, wherein an additional lever mechanism is provided, by means of which the axially mobile centering spindle may be moved away manually from the centering spindle.

13. A device according to claim 12, wherein the additional lever mechanism acts on the rocking lever or the counterweight.

14. A device according to claim 1, wherein the centering spindle guide comprises at least two linear guide units, which are arranged on each side of the axially mobile centering spindle in substantially play-free manner between the axially mobile centering spindle and a box-type structure surrounding it.

15. A device according to claim 14, wherein the axially mobile centering spindle comprises a spindle housing and a spindle shaft mounted rotatably therein, wherein each linear guide unit has a carriage attached to the spindle housing, which carriage is guided on a respectively associated guide rail attached to the box-type structure.

16. A device according to claim 15, wherein each carriage is equipped with a plurality of ball chains, which run in respectively associated longitudinal channels in the corresponding guide rail.

17. A device according to claim 15, wherein the spindle housing comprises, at least in part, a substantially rectangular external cross section, wherein a stop strip, extending parallel to the centering spindle axis, for the corresponding carriage is in each case constructed on an opposing side face of the spindle housing.

18. A device according to claim 14, wherein the box-type structure has four side walls preferably screwed together, which side walls define a cross-sectionally substantially rectangular cavity, in which the centering spindle guide is arranged.

19. A device according to claim 18, wherein the guide rails of the centering spindle guide are attached to opposing side walls of the box-type structure, wherein one of these side walls comprises a stop surface extending parallel to the centering spindle axis for the corresponding guide rail.

20. A device according to claim 19, wherein the side walls of the box-type structure bearing the guide rails of the centering spindle guide are arranged between the other two side walls wherein there is constructed on the latter in each case only one stop strip extending parallel to the centering spindle axis for the same side wall carrying the corresponding guide rail.

21. A device according to claim 18, wherein the box-type structure is surface-ground on a bearing surface perpendicular to the centering spindle axis after assembly of the side walls.

22. A device according to claim 14, wherein the centering spindle guide is equipped with a preferably contactless measuring system for a CNC control system, which measuring system comprises a slider attached to the axially mobile centering spindle together with a detection unit, fixed to the box-type structure, for the slider.

23. A device according to claim 22, wherein the slider is attached to one of the carriages of the linear guide units with at least one stay bolt, which passes through an opening in a side wall of the box-type structure, on which the detection unit is arranged.

24. A device according to claim 1, wherein one of the centering spindles is stationary in the axial direction and may be driven by means of a preferably CNC-controlled rotary actuator arranged concentrically to the centering spindle axis.

25. A device according to claim 24, wherein the rotary actuator also drives the axially mobile centering spindle via a first gear pair, a vertical shaft and a second gear pair.

26. A machine for edge machining of workpieces, in particular for centering edge machining and beveling of optical lenses, having a device for centering clamping of workpieces, in particular optical lenses, for machining of the edges thereof, having two aligned centering spindles arranged one above the other, which spindles each have mutually facing ends constructed to accommodate a bell clamp wherein at least one centering spindle is guided axially in a centering spindle guide and may be moved in the axial direction relative to the other centering spindle by means of a lifting apparatus, in order to align and chuck the workpiece; wherein a swivellable rocking lever is provided, with one end to which there is coupled the axially mobile centering spindle and with another end to which there is coupled at least one counterweight, in order to produce a moment at the rocking lever which counteracts the moment produced by the axially mobile centering spindle, and the machine for edge machining of workpieces having at least one driven tool spindle for a tool which may be brought into engagement with the workpiece.

27. A machine according to claim 26, wherein the tool spindle extending parallel to the centering spindle axis is offset angularly about the centering spindle axis relative to the linear guide units of the centering spindle guide.

28. A device for centering clamping of workpieces, in particular optical lenses, for machining of the edges thereof, having two aligned centering spindles arranged one above the other, which spindles each have mutually facing ends constructed to accommodate a bell clamp, wherein at least one centering spindle is guided axially in a centering spindle guide and may be moved in the axial direction relative to the other centering spindle by means of a lifting apparatus, in order to align and chuck the workpiece; wherein the lifting apparatus comprises a ball screw drivable by means of an electric motor, which ball screw serves to move one centering spindle relative to the other centering spindle in the axial direction, preferably under CNC control, in order to align the workpiece and also chuck it; and wherein the ball screw comprises a rotatably mounted roller ball spindle connected for drive with the electric motor, which spindle engages with a nut which is connected non-rotatably with a linearly guided clamping saddle.

29. A device according to claim 28, wherein one of the centering spindles is stationary in the axial direction and may be driven by means of a preferably CNC-controlled rotary actuator arranged concentrically to the centering spindle axis.

30. A device according to claim 29, wherein the rotary actuator also drives the axially mobile centering spindle via a first gear pair, a vertical shaft and a second gear pair.

31. A device for centering clamping of workpieces, in particular optical lenses, for machining of the edges thereof, having two aligned centering spindles arranged one above the other, which spindles each have mutually facing ends constructed to accommodate a bell clamp, wherein at least one centering spindle is guided axially in a centering spindle guide and may be moved in the axial direction relative to the other centering spindle by means of a lifting apparatus, in order to align and chuck the workpiece; wherein the centering spindle guide comprises at least two linear guide units, which are arranged on each side of the axially mobile centering spindle in substantially play-free manner between the axially mobile centering spindle and a box-type structure surrounding it;

wherein the axially mobile centering spindle comprises a spindle housing and a spindle shaft mounted rotatably therein, wherein each linear guide unit has a carriage attached to the spindle housing, which carriage is guided on a respectively associated guide rail attached to the box-type structure; and wherein the spindle housing comprises, at least in part, a substantially rectangular external cross section, wherein a stop strip, extending parallel to the centering spindle axis, for the corresponding carriage is in each case constructed on an opposing side face of the spindle housing.

32. A device according to claim 31, wherein each carriage is equipped with a plurality of ball chains, which run in respectively associated longitudinal channels in the corresponding guide rail.

33. A device according to claim 31, wherein the box-type structure has four side walls preferably screwed together, which side walls define a cross-sectionally substantially rectangular cavity, in which the centering spindle guide is arranged.

34. A device according to claim 33, wherein the guide rails of the centering spindle guide are attached to opposing side walls of the box-type structure, wherein one of these side walls comprises a stop surface extending parallel to the centering spindle axis for the corresponding guide rail.

35. A device according to claim 34, wherein the side walls of the box-type structure bearing the guide rails of the centering spindle guide are arranged between the other two side walls, wherein there is constructed on the latter in each case only one stop strip extending parallel to the centering spindle axis for the same side wall carrying the corresponding guide rail.

36. A device according to claim 33, wherein the box-type structure is surface-ground on a bearing surface perpendicular to the centering spindle axis after assembly of the side walls.

37. A device according to claim 31, wherein the centering spindle guide is equipped with a preferably contactless measuring system for a CNC control system, which measuring system comprises a slider attached to the axially mobile centering spindle together with a detection unit, fixed to the box-type structure, for the slider.

38. A device according to claim 37, wherein the slider is attached to one of the carriages of the linear guide units with at least one stay bolt, which passes through an opening in a side wall of the box-type structure, on which the detection unit is arranged.

39. A device according to claim 31, wherein one of the centering spindles is stationary in the axial direction and may be driven by means of a preferably CNC-controlled rotary actuator arranged concentrically to the centering spindle axis.

40. A device according to claim 39, wherein the rotary actuator also drives the axially mobile centering spindle via first gear pair, a vertical shaft and a second gear pair.

41. A device for centering clamping of workpieces, in particular optical lenses, for machining of the edges thereof, having two aligned centering spindles arranged one above the other, which spindles each have mutually facing ends constructed to accommodate a bell clamp, wherein at least one centering spindle is guided axially in a centering spindle guide and may be moved in the axial direction relative to the other centering spindle by means of a lifting apparatus, in order to align and chuck the workpiece; wherein the centering spindle guide comprises at least two linear guide units, which are arranged on each side of the axially mobile centering spindle in substantially play-free manner between the axially mobile centering spindle and a box-type structure surrounding it;

wherein the box-type structure has four side walls preferably screwed together, which side walls define a cross-sectionally substantially rectangular cavity, in which the centering spindle guide is arranged; and wherein the guide rails of the centering spindle guide are attached to opposing side walls of the box-type structure, wherein one of these side walls comprises a stop surface extending parallel to the centering spindle axis for the corresponding guide rail.

42. A device according to claim 41, wherein the side walls of the box-type structure bearing the guide rails of the centering spindle guide are arranged between the other two side walls, wherein there is constructed on the latter in each case only one stop strip extending parallel to the centering spindle axis for the same side wall carrying the corresponding guide rail.

43. A device according to claim 41, wherein the box-type structure is surface-ground on a bearing surface perpendicular to the centering spindle axis after assembly of the side walls.

44. A device according to claim 41, wherein the centering spindle guide is equipped with a preferably contactless measuring system for a CNC control system, which measuring system comprises a slider attached to the axially mobile centering spindle together with a detection unit, fixed to the box-type structure, for the slider.

45. A device according to claim 44, wherein the slider is attached to one of the carriages of the linear guide units with at least one stay bolt, which passes through an opening in a side wall of the box-type structure, on which the detection unit is arranged.

46. A device according to claim 41, wherein one of the centering spindles is stationary in the axial direction and may be driven by means of a preferably CNC-controlled rotary actuator arranged concentrically to the centering spindle axis.

47. A device according to claim 46, wherein the rotary actuator also drives the axially mobile centering spindle via first gear pair, a vertical shaft and a second gear pair.

48. A device for centering clamping of workpieces, in particular optical lenses, for machining of the edges thereof, having two aligned centering spindles arranged one above the other, which spindles each have mutually facing ends constructed to accommodate a bell clamp, wherein at least one centering spindle is guided axially in a centering spindle guide and may be moved in the axial direction relative to the other centering spindle by means of a lifting apparatus, in order to align and chuck the workpiece; wherein the lifting apparatus comprises a ball screw drivable by means of an electric motor, which ball screw serves to move one centering spindle relative to the other centering spindle in the axial direction, preferably under CNC control, in order to align the workpiece and also chuck it; and wherein the centering spindle guide comprises at least two linear guide units, which are arranged on each side of the axially mobile centering spindle in substantially play-free manner between the axially mobile centering spindle and a box-type structure surrounding it;

wherein the axially mobile centering spindle comprises a spindle housing and a spindle shaft mounted rotatably therein, wherein each linear guide unit has a carriage attached to the spindle housing, which carriage is guided on a respectively associated guide rail attached to the box-type structure; and wherein the spindle housing comprises, at least in part, a substantially rectangular external cross section, wherein a stop strip, extending parallel to the centering spindle axis, for the corresponding carriage is in each case constructed on an opposing side face of the spindle housing.

49. A device according to claim 48, wherein the box-type structure has four side walls preferably screwed together, which side walls define a cross-sectionally substantially rectangular cavity, in which the centering spindle guide is arranged.

50. A device according to claim 49, wherein the guide rails of the centering spindle guide are attached to opposing side walls of the box-type structure, wherein one of these side walls comprises a stop surface extending parallel to the centering spindle axis for the corresponding guide rail.

51. A device according to claim 50, wherein the side walls of the box-type structure bearing the guide rails of the centering spindle guide are arranged between the other two side walls, wherein there is constructed on the latter in each case only one stop strip extending parallel to the centering spindle axis for the same side wall carrying the corresponding guide rail.

52. A device according to claim 49, wherein the box-type structure is surface-ground on a bearing surface perpendicular to the centering spindle axis after assembly of the side walls.

53. A device according to claim 48, wherein the centering spindle guide is equipped with a preferably contactless measuring system for a CNC control system, which measuring system comprises a slider attached to the axially mobile centering spindle together with a detection unit, fixed to the box-type structure, for the slider.

54. A device according to claim 53, wherein the slider is attached to one of the carriages of the linear guide units with at least one stay bolt, which passes through an opening in a side wall of the box-type structure, on which the detection unit is arranged.

55. A device according to claim 48, wherein one of the centering spindles is stationary in the axial direction and may be driven by means of a preferably CNC-controlled rotary actuator arranged concentrically to the centering spindle axis.

56. A device according to claim 55, wherein the rotary actuator also drives the axially mobile centering spindle via a first gear pair, a vertical shaft and a second gear pair.

57. A device according to claim 48, wherein each carriage is equipped with a plurality of ball chains, which run in respectively associated longitudinal channels in the corresponding guide rail.

58. A device for centering clamping of workpieces, in particular optical lenses, for machining of the edges thereof, having two aligned centering spindles arranged one above the other, which spindles each have mutually facing ends constructed to accommodate a bell clamp, wherein at least one centering spindle is guided axially in a centering spindle guide and may be moved in the axial direction relative to the other centering spindle by means of a lifting apparatus, in order to align and chuck the workpiece; wherein the lifting apparatus comprises a ball screw drivable by means of an electric motor, which ball screw serves to move one centering spindle relative to the other centering spindle in the axial direction, preferably under CNC control, in order to align the workpiece and also chuck it; and wherein the centering spindle guide comprises at least two linear guide units, which are arranged on each side of the axially mobile centering spindle in substantially play-free manner between the axially mobile centering spindle and a box-type structure surrounding it;

wherein the box-type structure has four side walls preferably screwed together, which side walls define a cross-sectionally substantially rectangular cavity, in which the centering spindle guide is arranged; and wherein the guide rails of the centering spindle guide are attached to opposing side walls of the box-type structure, wherein one of these side walls comprises a stop surface extending parallel to the centering spindle axis for the corresponding guide rail.

59. A device according to claim 58, wherein the side walls of the box-type structure bearing the guide rails of the centering spindle guide are arranged between the other two side walls, wherein there is constructed on the latter in each case only one stop strip extending parallel to the centering spindle axis for the same side wall carrying the corresponding guide rail.

60. A device according to claim 58, wherein the box-type structure is surface-ground on a bearing surface perpendicular to the centering spindle axis after assembly of the side walls.

61. A device according to claim 58, wherein the centering spindle guide is equipped with a preferably contactless measuring system for a CNC control system, which measuring system comprises a slider attached to the axially mobile centering spindle together with a detection unit, fixed to the box-type structure, for the slider.

62. A device according to claim 61, wherein the slider is attached to one of the carriages of the linear guide units with at least one stay bolt, which passes through an opening in a side wall of the box-type structure, on which the detection unit is arranged.

63. A device according to claim 61, wherein one of the centering spindles is stationary in the axial direction and may be driven by means of a preferably CNC-controlled rotary actuator arranged concentrically to the centering spindle axis.

64. A device according to claim 63, wherein the rotary actuator also drives the axially mobile centering spindle via a first gear pair, a vertical shaft and a second gear pair.

* * * * *